US005301832A

United States Patent [19]

Daniels

[11] Patent Number: 5,301,832

[45] Date of Patent: Apr. 12, 1994

[54] METHOD OF AND MEANS FOR DISPENSING SHOPPING BAGS FROM DIFFERENT SIZE BAG PACKS

[75] Inventor: Mark E. Daniels, Redondo Beach, Calif.

[73] Assignee: The Avantage Group, Inc., Redondo Beach, Calif.

[21] Appl. No.: 49,978

[22] Filed: Apr. 19, 1993

Related U.S. Application Data

[63] Continuation-in-part of Ser. No. 32,141, Mar. 17, 1993, which is a continuation of Ser. No. 871,856, Apr. 21, 1992, Pat. No. 5,205,435.

[51] Int. Cl.[5] ..... A47K 10/24

[52] U.S. Cl. ..... 221/44; 206/554; 383/9

[58] Field of Search ..... 221/33, 44; 248/95, 248/97, 99; 206/554, 806; 383/8-10

[56] References Cited

U.S. PATENT DOCUMENTS 4,759,639 7/1988 De Matteis ..... 206/554

4,811,417 3/1989 Prince et al. ..... 206/554

*Primary Examiner*—D. Glenn Dayoan
*Assistant Examiner*—Kenneth Noland
*Attorney, Agent, or Firm*—Beehler & Pavitt

[57] ABSTRACT

A method and device for dispensing plastic shopping bags in one or more different packs, each pack having bags of the same size with hook-receiving openings in the vicinity of the top edges of its bags, the device including a rack behind and below which is provided a downwardly extending hooking element centrally aligned with the bar. The bags of each pack may be brought up and draped over the mounting plate in reverse position, then their hook-receiving openings are pushed over the hooking elements. After being so disposed and hooked, the bags are then brought back forward from their reverse position and draped over the transverse bar to cause them to hang downwardly in front of the hooking element. Removal of a bag is accomplished by grasping the downwardly hanging bag and pulling out from the remainder of the draped bag packs to detach it from the hooking element.

4 Claims, 2 Drawing Sheets

Fig. 1
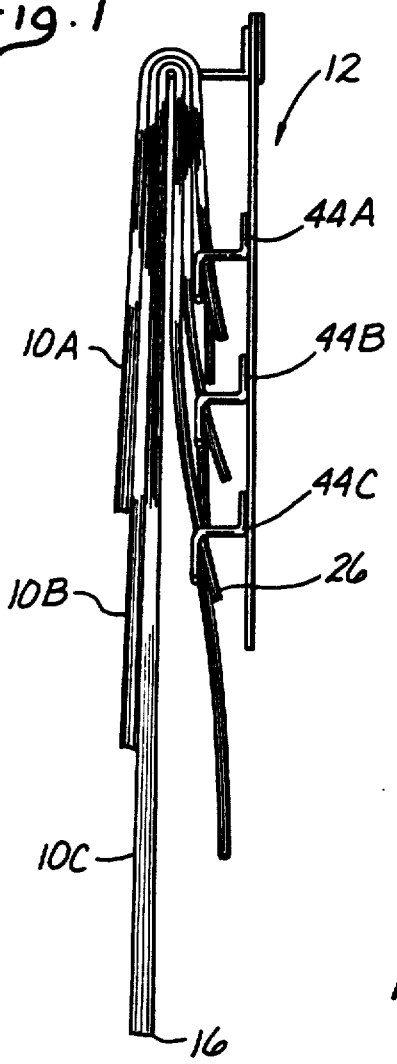
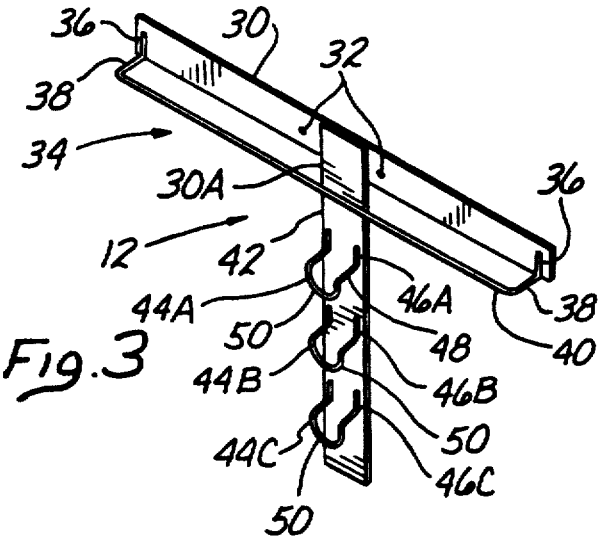
Fig. 3
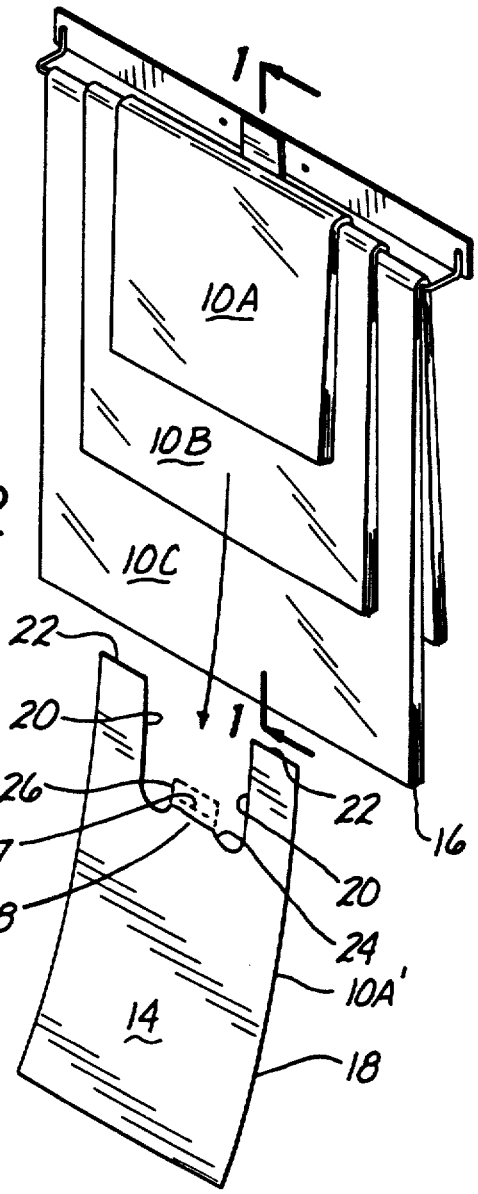
Fig. 2
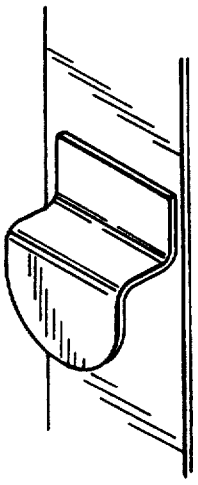
Fig. 4

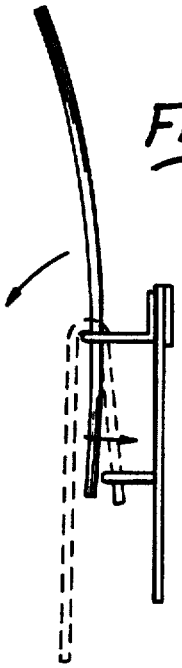
Fig. 5
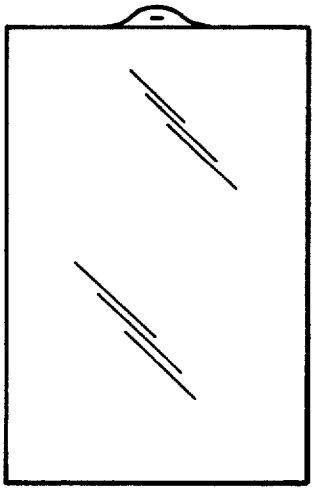
Fig. 6
Fig. 7
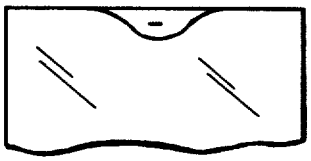
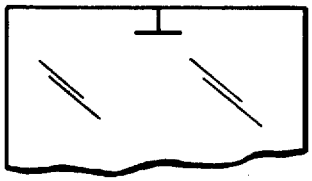
Fig. 8
Fig. 9
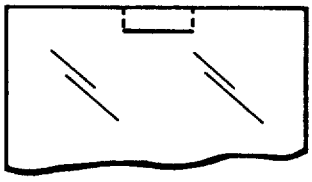
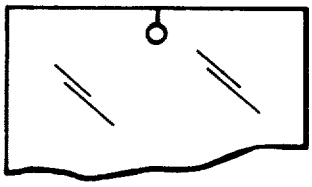
Fig. 10
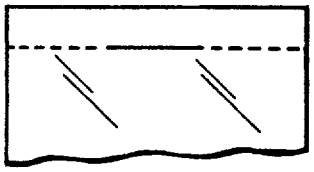
Fig. 11
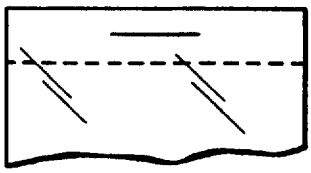
Fig. 12

METHOD OF AND MEANS FOR DISPENSING SHOPPING BAGS FROM DIFFERENT SIZE BAG PACKS

This is a continuation-in-part of application Ser. No. 08/032,141 filed Mar. 17, 1993, which is a continuation of application Ser. No. 07/871,856, filed Apr. 21, 1992, now U.S. Pat. No. 5,205,435.

FIELD OF THE INVENTION

This invention relates to the field of plastic shopping bags and the dispensing of what are known as "T-shirt style merchandising bags" which are made available in packs of identical size bags in boxes or otherwise provided with one bag on top of the others. It also relates to other configurations of plastic shopping bags which are known as "merchandise bags," which are also available in the same formats as "T-shirt style merchandising bags".

BACKGROUND OF THE INVENTION

In recent years, plastic merchandise bags of various types have largely supplanted paper bags in retail stores. Among the reasons for this development are the fact that plastic bags are cheaper, easier to handle, to ship and to store, and more easily recycled and may be readily provided in a plurality of different sizes and configurations which they may often desire to hand to the customer at the time of sale in a shopping bag of a size most suitable to encompass the particular item or items of merchandise.

Among the more popular types of plastic bags are what have been termed "T-shirt" style merchandising bags and various other configurations of bags known as "merchandise bags". These may be provided by plastic bag manufacturers, either in rolls, or in a series of interconnected bags blocked-on-headers or fused together in some other fashion, or in packs in which bags of identical size and configuration are placed one upon another and may be shipped to the retailer in boxes or plastic or other wrappings. The present invention involves the dispensing of the latter types of bag packages i.e., those not shipped to the retailer in rolls.

The T-shirt bag in the non-rolled shipped form comprises a pair of side panels which are connected along their side and bottom edges to define a cavity adapted to receive articles. Each side of the bag towards it upper area is provided with a pair of straps spaced apart from each other. The straps of the two sides of the panels are joined together along their upper edges and may be open along their side edges, thereby to form two separate handles with open spacing between them above the upper open edges of the bag. These upper edges are not closed except for a small center area where the two abutting edges are joined by a pair of detachable looped or slotted extensions, known as blocked headers or tabs. These headers are not only joined together, but they may be joined with the corresponding extensions of adjacent bags, thereby to enable packs of bags to be kept together for handling and mounting on some type of horizontally extending projection which may be passed through the registering loops or slots in the extensions of a bag pack. In this manner, these extensions provide a hook-receiving opening. Examples of such mountings are shown in U.S. Pat. Nos. 4,819,898; 4,840,335; 4,981,216; 4,995,860 and 5,020,750.

All configurations of non-rolled merchandise bags have a closed bottom and sides with an open top defined by edges extending between the sides. These bags may be manufactured to incorporate a hook-receiving opening at a predetermined location, either above or below the open top of the bags. These bags may be joined together by fusing them in a variety of ways, enabling packs of bags to be kept together for handling and mounting in some type of horizontally extending projection which may be passed through the hook-receiving opening of a bag pack.

Heretofore, as seen from the patents listed above, principal attention has been given primarily to providing a method and means for dispensing bags of a single size, such as those for groceries in supermarkets.

The supermarket racks and techniques, however, are not satisfactory for merchandisers of garments, cosmetics, footwear, household articles, personal items, etc. A retailer vending any variety of goods ordinarily desires to be able to deposit the customer's purchases in some type of convenient shopping bag—one which is appropriate in size to the size of the item purchased. This renders it desirable for a retailer's cashier checkout station to have available packs of a plurality of one or more sizes of bags. However, if each different size bag pack is separately and singly mounted for ripping off and removal by the cashier or other store clerk, not only will considerable space be required, but also it may be necessary for the clerk to waste time and energy moving about to reach the different bag packs. This is not only inconvenient, but may be fatiguing for the clerks. What is desirable, therefore, is some type of rack arrangement whereby a plurality of packs of different size bags may be mounted together for convenient removal by a clerk exerting a minimum of effort and movement in or about his or her work station. It is also desirable to provide a simple method and means for dispensing bags from a single sized pack.

SUMMARY OF THE INVENTION

The present invention provides a convenient and ergonomically efficient system and means for enabling a cashier or store clerk to secure the most desirable size bag appropriate for the size of the particular merchandise which is being paid for at the cashier's or packing clerk station. What is entailed is providing a rack in the form of a transverse bar, supported at its ends away from a wall or from a vertical or horizontal counter surface, behind and below which, centrally disposed with respect to such bar on such wall or vertical or horizontal counter surface, area single or a plurality of downwardly extending hooking elements spaced apart from each other. Where a plurality of different sized bags are to be handled, or even a plurality of packs of the same sized bags, the uppermost of these hooking elements is passed through the hook-receiving openings of the pack of the smallest size bags and the bags of this pack are brought up and laid over the transverse mounting plate in a reversed position. Similarly, the hooking element next below the uppermost element is passed through the hook-receiving openings of the bag pack of the next largest size bag and the bags of the pack are brought up and laid over the smallest size bags on the transverse mounting plate, again in transverse position. One or more additional packs, starting with the next largest in size, is similarly mounted on the hook next below the upper hooks and the bags are brought up over the transverse mounting plate and laid on the preceding smaller size bags in a reverse position. After the last pack is similarly hooked, the several packs are then brought forward and draped over the transverse bar. In each instance, when the bags of a pack are folded into their correct position and are brought over the transverse bar, a substantial portion of each bag will be allowed to drop or fall down from the transverse bar. While a single pack may be so mounted on one of the hooks and brought over the bar or as many as four or five different packs may be thus mounted, the ideal number of different size packs would appear to be one to three, although this may vary depending upon the thickness of each pack and the weight of the bags of the packs.

The reason for initially flipping the packs of bags over the transverse mounting plate at the time of passing the hook-receiving openings of the bag pack onto the hooking element is so that other packs may be mounted immediately following on one or more lower disposed hooking elements. However, where only one pack is to be mounted on the rack and a single hooking element, although flipping the bag over the transverse mounting plate facilitates pushing the hook-receiving openings of the bag pack over the hooking element, this could be obviously accomplished by simply bringing the top of the bag pack over the transverse bar and reaching under the bag pack to push the hook-receiving openings on the hooking element.

When a plurality of packs of bags have thus been mounted, it will be readily appreciated that the cashier or other store clerk has readily available in one location a selection of one or more different sized bags. The clerk may then simply lift the top bag of any of the several packs and jerk it across the transverse bar, thereby detaching it from its hook-receiving opening so that it may be slipped out, not only from its own pack, but between such of the other packs of bags which may be laid over its pack. The "T-shirt" style bag so removed comes over the bar with its straps and open top last, whereupon the clerk may conveniently open the bag and place the articles of merchandise inside it. The two straps of the bag may either be tied, or the bag may be handed to the customer in such a manner that the customer may slip his or her hand or fingers through the straps and carry away the purchase. Merchandise bags of other configurations would also come off the bar with their open tops last.

The bar and its end supports may be formed integrally with means for supporting the several hooked elements, or alternatively, the bars and their supports may be separated from the hook supports. Desirably, the hooking elements should be U-shaped heavy wire or rod members secured at both ends to a base with the "U" portion bent downwardly part way from its end. The hook, however, could take a number of different forms, such as a V-shape or, even, rectangular. While a bent wire type hook is preferred, the hook could be in the form of a flat metal or plastic element. The hook could even be in the form of a peg projecting at least 90 degrees downwardly from the vertical.

It will be appreciated from a consideration of the foregoing and the detailed description with reference to the drawing which hereafter follows that the present invention provides a most convenient and ergonomically effective means and method for mounting and dispensing packs of not only T-shirt type bags, but various configurations of merchandise bags, and, particularly, where packs of bags of different sizes may be required.

DESCRIPTION OF THE DRAWINGS

In the accompanying drawings,

FIG. 1 is a side elevation partly in section, showing a rack with a plurality of packs of T-shirt style bags of different sizes mounted in accordance with the present invention.

FIG. 2 is a perspective view of a rack holding a plurality of packs of different sizes of T-shirt type bags, and illustrating the removal of one of such bags.

FIG. 3 is a perspective view of the rack of the present invention.

FIG. 4 is an enlarged view of an alternate type of hooking element from that shown in FIGS. 1 and 3.

FIG. 5 is a side elevation showing how a single pack of merchandise bags could be mounted on a rack in accordance with the present invention.

FIGS. 6–12 illustrate a number of different styles of merchandise bags besides a T-shirt type bag to which the present invention may be applicable.

DESCRIPTION OF THE PREFERRED EMBODIMENTS

Referring to FIGS. 1 and 2 of the drawing, three different size packs of T-shirt style bags 10A, 10B and 10C are shown mounted on a rack 12. In the example so illustrated, the bags of the pack 10A are smaller than those of pack 10B, 10C, and the bags of the pack 10B are smaller than the bags of the pack 10C. Each individual bag of each of the three packs 10A, 10B, and 10C is of the configuration of the bag 10A shown in FIG. 2 after its removal from the pack 10A. As may be observed, each bag in each of the packs comprises a pair of oppositely facing panels 14 joined along their bottoms 16 and side edges 18. The side edges 18 have a pair of upwardly extending strap extensions 20 which are closed along their top edges 22. The upper portion 24 of the panels 14 are open between the straps 20 except for a detachable slotted center closure 26 shown in dotted lines on the removed bag 14 at the bottom of FIG. 2. When packs of bags are produced, the closures 26 not only close a portion of the top edges 24 of the panels 14, but the closures 26 are also secured to the adjacent closures 26 of bags forming the pack. Each closure 26 is fairly easily detachable from the upper edges 24 since the bottom edge of the closure 26 where it joins the center of the edges 24 is perforated. This bag construction is well known and forms no part of the present invention, which is providing the rack 12 and mounting packs of different size bags 10A, 10B and 10C in the manner hereinafter described.

As best seen in FIG. 3, the rack of the present invention comprises a transverse plate 30 which may be designed to be mounted to the wall or any other vertical or horizontal surface by screws (not shown) which are inserted in holes 32. Welded or otherwise secured to the ends of the plate 30 is a U-shaped member 34 which is bent at its ends once to provide a segment 36 which may be welded or secured to the plate 30, and again to provide an end support 38 for the transverse bar portion 40. Desirably, for convenience, a vertical hook supporting plate 42 may be welded or bolted at the center 30*a* of the plate 30 to extend downwardly therefrom. The vertical plate 42 serves to carry a plurality of hooking elements 44A, 44B, 44C spaced apart from each other. In the embodiment illustrated, these hooking elements comprise U-shaped wire members bent once, to provide segments 46A, 46B, 46C respectively, secured to the vertical plate 42, and outwardly projecting segments 48; and further bent to produce downwardly extending end segments 50. Although 44A, 44B and 44C are shown as formed of rigid bent wires or rods, they could also be formed as the solid plates shown in FIG. 4.

With the rack mounted on a wall, a side of a counter, under a counter, or some other readily accessible vertical or horizontal surface, a plurality of packs of bags are then placed over the rack in the following manner:

The strap ends 22 of the smallest bag pack 10A is slipped over the transverse bar portion 40 of the U-shaped member 34 and between that member 40 and the plate 30, and these strap ends 22 are brought down below the hooked element 44A and the hooked element 44A is passed through the slotting 27 in the detachable closures 26 of the bags 10A. The remainder of the bag pack 10A is then draped over the transverse plate 30 in a reverse position.

The second smaller pack 10B is similarly brought over the transverse bar 40 and hooked on to the hooking element 44B and draped over the bag pack 10A, also in a reverse position.

Similarly, the large bag pack 10C is hooked on to the hooking element 44C and draped in a reverse position over the portions of the bag packs 10A and 10B which have been draped in a reverse position respectively over the transverse plate 30. When all three packs of bags are hooked as described above, all three packs are then folded over the transverse bar 40 so that a large portion of them, is draped over the transverse bar 40. The remainder, or hooked portion, of the bag fits into the gap 38, as shown in FIGS. 1 and 2.

With the three packs thus mounted on the rack 34 and the latter secured to a wall or vertical or horizontal portion of the counter adjacent the cashier or clerk, the latter is in a position to remove a bag from any of the three different size packs by simply grasping the panel portion 14 of the top bag of any of the three packs, 10A, 10B and 10C and pulling it, desirably with a slight jerk, thereby effecting a detachment of the center edge 24 from the closure 26. Because the plastic shopping bags, for the dispensing of which the present invention is directed, have lubricous surfaces, any individual bag thus pulled from a pack, even though that pack may be covered by one or more other packs, e.g. 10B and/or 10A, will be found to be readily removable from the rack 34. As a consequence, the cashier or clerk may most conveniently withdraw from the rack 34 carrying packs of different size bags mounted as shown in FIGS. 1 and 2, an appropriate size bag for enclosing the article or articles arriving at the point of sale.

While the foregoing description with reference to FIGS. 1–4 has been particularly directed to the mounting of the T-shirt type merchandise bags, the rack and method of mounting of the invention are obviously applicable to many other configurations of merchandise bags which are designed for removably mounting them on a hooking element and draping them over a supporting transverse bar, for individual removals by a clerk and insertion of merchandise. A number of different possible configurations of merchandise bags and their hook-receiving openings are shown in FIGS. 6–12 of the drawings. In addition, FIG. 5 illustrates how a single bag pack could be mounted on the hooking element without first flipping it over the transverse mounting plate in the manner necessary to allow for the convenient hooking of additional bag packs on one or more lower disposed hooking elements.

I claim:

1. A method of providing dispensable merchandise bags from a pack of coinciding plastic bags, each bag of the pack having a closed bottom and sides, and an open top defined by edges extending between the sides, said open top having a hook-receiving opening positioned in the vicinity of said top defining edges, said method comprising:

(a) providing a rack with a projecting transverse bar;

(b) providing a hooking element, said element extending downwardly at an angle at least 90 degrees from the vertical, said element being disposed below the level of the bar and aligned centrally with the bar to project below the bar and being spaced from the bar;

(c) draping the lower portions of the bags of the bag pack over the rack in a reverse position;

(d) hooking the hook-receiving openings of the pack of bags over the hooking element;

(e) draping the lower portions of the hooked bag pack over the rack forward over the transverse bar to cause said lower portion to hang downwardly over the bar in front of the U-shaped member; and (f) removing a bag in the bag pack from the rack and the hooking element by grasping the top bag draped over the transverse bar and hanging downwardly therefrom, and pulling the bag to detach it from the hooking element.

2. A method of providing dispensable merchandise bags from a pack of coinciding plastic bags, each bag of the pack having a closed bottom and sides and an open top defined by edges extending between the sides, said open top having a hook-receiving opening in the vicinity of said top defining edges, said method comprising:

(a) providing a rack with a transverse bar projecting horizontally in a predetermined direction;

(b) providing a hooking element disposed below and behind said bar, said hooking element projecting also in said predetermined direction at at least a 90 degree angle downwardly from the vertical, said hooking element being insertable in the hook receiving openings in the bags of said pack;

(c) inserting the hooking element into the hook-receiving openings in the bags of the pack thereby removably to retain the tops of the bags on said hooking element;

(d) draping the lower portions of the hooked bags over the bar to cause said lower bag portions to hang downwardly in front of the bar and in front of the hooking element; and (e) removing bags in the pack one at a time from the transverse bar by grasping the top bag of the pack draped over the bar and pulling the last said bag against the hooking element to free the bag from retention by the hooking element.

3. Rack means for providing dispensable merchandise bags from a pack of plastic bags, each bag in the pack having a closed bottom and sides, and an open top between the sides, said open top having a hook-receiving opening in the vicinity of the top edges, said rack means comprising:

(a) a transverse bar;

(b) means to support said bar at its ends from a vertical wall, or other vertical surface;

(c) a hooking member, said member being disposed below the level of the bar and behind the bar toward the vertical surface and such member being aligned centrally with the bar to project below the bar at least 90 degrees from the vertical, and being spaced from the bar;

whereby the hook-receiving openings of the pack of bags may be hooked over the hooking member, and the pack of bags may be draped over the transverse bar for removal by pulling the uppermost bag on the bar away from the hooking member to detach the bag from the hooking member.

4. A merchandise bag dispensing combination comprising:

(a) a rack in the form of a rectilinear bar of a predetermined length, said bar being supported in a horizontal position in a first vertical plane by a pair of parallel elements spaced from each other and having first ends in supporting engagement with the bar and their second opposite ends extending in a direction away from the bar and secured against movement at points on a horizontal line parallel to the bar;

(b) a hooking element, said hooking element being disposed below the bar and having its first and hooking end in a second vertical plane behind said first vertical plane, and its second and supporting end anchored in a position more remote from the bar and the second vertical plane, said hooking element projecting from its anchoring position toward the first vertical plane in a direction at at least a 90 degree angle downward from the vertical line through said anchoring position; and (c) a pack of coinciding plastic merchandising bags, each bag of the pack having closed bottom and sides and an open top defined by edges extending between the sides, said open top having a hook-receiving opening positioned in the vicinity of said top defining edges, the hooking element being inserted through the hook-receiving openings, and the pack of bags being laid over the rectilinear bar so that at least the lower portions of the bags of the pack hang down from the bar, whereby bags may be individually removed from the rack and hooking element by grasping the top bag on the bar and pulling it away from the hooking element.

* * * * *